US010662592B1

(12) United States Patent
Berns

(10) Patent No.: US 10,662,592 B1
(45) Date of Patent: May 26, 2020

(54) SCREED HEATING ELEMENT HOLDER

(71) Applicant: Caterpillar Paving Products Inc., Brooklyn Park, MN (US)

(72) Inventor: Reece A. Berns, Big Lake, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/263,507

(22) Filed: Jan. 31, 2019

(51) Int. Cl.
*E01C 23/14* (2006.01)
*E01C 19/48* (2006.01)

(52) U.S. Cl.
CPC ..... *E01C 19/4866* (2013.01); *E01C 2301/10* (2013.01); *E01C 2301/16* (2013.01)

(58) Field of Classification Search
CPC ..... E01C 2301/10
USPC ..... 404/95, 118
See application file for complete search history.

(56) References Cited

U.S. PATENT DOCUMENTS 6,318,928 B1 * 11/2001 Swearingen ..... E01C 19/42 404/72
7,427,174 B2 * 9/2008 Dearing ..... E01C 19/407 404/118
8,113,737 B2 * 2/2012 Mahler ..... E01C 19/407 404/118
8,113,738 B2 * 2/2012 Mahler ..... E01C 19/407 404/118
8,157,474 B2 * 4/2012 Mahler ..... E01C 19/48 404/118
8,517,630 B2 * 8/2013 Graham ..... E01C 19/48 404/118
9,181,662 B2 11/2015 Kopacz et al.
9,249,544 B2 * 2/2016 Caputo ..... E01C 19/4833
9,885,158 B2 2/2018 Grimm et al.
9,988,771 B2 * 6/2018 Caputo ..... C23C 4/126
10,113,274 B2 * 10/2018 Caputo ..... C23C 4/126
10,280,571 B2 * 5/2019 Caputo ..... C23C 4/126
10,443,196 B2 * 10/2019 Caputo ..... C23C 4/134
2014/0377003 A1 * 12/2014 Kopacz et al. ..... E01C 19/4873 404/118
2016/0186389 A1 * 6/2016 Graham ..... E01C 19/48 404/79
2019/0024326 A1 * 1/2019 Caputo ..... C23C 4/126
2019/0390416 A1 * 12/2019 Caputo ..... C23C 4/06

FOREIGN PATENT DOCUMENTS

JP H10252012 9/1998
WO 2018136049 7/2018

* cited by examiner

*Primary Examiner* — Gary S Hartmann
(74) *Attorney, Agent, or Firm* — Schwegman, Lundberg & Woessner

(57) ABSTRACT

A screed assembly for use with a paving machine. The screed assembly can comprise: a screed plate; a holder configured to be removably connected to the screed plate and configured to be positioned thereon, wherein when connected thereto the screed plate and the holder form a channel having an opening at one end thereof; and a heater assembly having a heating element configured to be received in the channel and to be aligned by the holder when so received relative to an axis of symmetry of the screed plate.

19 Claims, 5 Drawing Sheets

SCREED HEATING ELEMENT HOLDER

TECHNICAL FIELD

The present application relates generally to apparatuses and systems that enable the ease of removal and installation of screed heating elements in working machines. More particularly, the present application relates to an apparatus and and system for clamping the screed heating elements with a consistent clamping force that is evenly distributed to promote improved heat transfer.

BACKGROUND

Pavers or paving machines are working machines used in a paving process to create a new road surface. Such pavers assist in pouring and spreading paving material to form a new roadway surface or mat. With asphalt pavers, an aggregate filled bituminous mixture that comprises the paving material is spread while hot and is then compacted so that a hardened pavement surface is formed upon cooling. Pavers typically utilize a heavy assembly termed a "screed" that is drawn behind the paving machine. The screed assembly includes a replaceable screed plate to spread a smooth even layer of paving material on the prepared roadbed. The weight and/or a vibration of the screed assembly aids in compressing the paving material and performing initial compaction of the paving material layer.

To facilitate laying of the paving material, the screed plate is typically heated, to a temperature in the range of about 82° to 171° C. (180° to 340° F.). Heating the screed plate assists the paving material in flowing under the screed plate and reduces adhesion of the paving material to the screed plate. If the screed plate is not adequately heated, the bituminous mixture contacting the bottom of the screed plate begins to harden, resulting in buildup of paving material and excessive drag.

Some screeds such as those of U.S. Pat. No. 9,181,662 have an opening on the trailing edge. Although this can improve heat transfer and access to the heater, it can allow for asphalt and debris to get into the heating chamber. Debris can negatively impact heater removal and installation, heat transfer uniformity, etc. Other screed designs utilize a separate cover and/or multiple hold down components. These components and/or the screed plate need to be removed to change heating elements. However, the heavy nature of the equipment and the design of conventional screed assemblies typically requires that any such maintenance be carried at a depot or shop location, which can increase time spent in maintenance.

SUMMARY OF THE INVENTION

In one example, a screed assembly for use with a paving machine is disclosed. The screed assembly can comprise: a screed plate; a holder configured to be removably connected to the screed plate and configured to be positioned thereon, wherein when connected thereto the screed plate and the holder form a channel having an opening at one end thereof; and a heater assembly having a heating element configured to be received in the channel and to be aligned by the holder when so received relative to an axis of symmetry of the screed plate.

In another example, a paving system for laying an asphalt paving material is disclosed. The system can comprise: a paving machine and a screed assembly configured to be removably connected to the paving machine. The screed assembly can comprise: a screed plate; a holder configured to be removably connected to the screed plate and configured to be positioned thereon, wherein when connected thereto the screed plate and the holder form a channel having an opening at one end thereof; a heater assembly having a heating element configured to be received in the channel; and a screed frame configured to be spaced from the screed plate and holder along trailing sides thereof to provide an first opening for access to the holder.

In another example, a screed assembly for use with a paving machine, is disclosed. The screed assembly can comprise: a screed plate; a holder configured to be removably connected to the screed plate and configured to be positioned thereon, wherein when connected thereto the screed plate and the holder form a channel having an opening at one end thereof; and a heater assembly having a heating element configured to be received in the channel, wherein the channel and heating element are separated from a trailing edge of the screed plate by the holder such that the holder acts as a cover to protect the heating element from debris.

DETAILED DESCRIPTION

Figure 1:
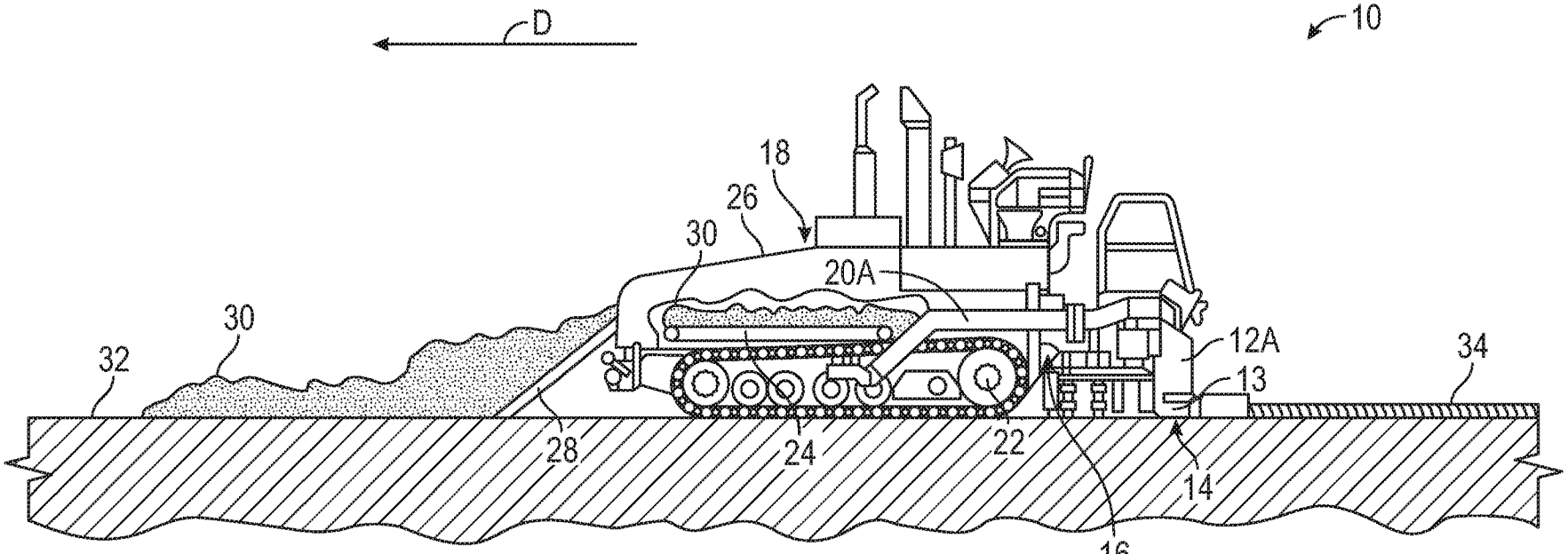
FIG. 1 is a schematic side view of an asphalt paving machine showing a screed assembly according to an example of the present application.

FIG. 1 is a schematic side view of an asphalt paving machine 10 showing a screed side plate 12A of a screed assembly 14 positioned rearward of an auger system 16. The asphalt paving machine 10 can comprise a vehicle portion 18, which can be connected to the screed assembly 14 via a tow arm 20A. The paving machine 10 can additionally a second side plate (not shown) and a screed plate 13. A second tow arm (not shown) can also be provided in some cases. The vehicle portion 18 can additionally comprise a propulsion element 22, a conveyor system 24, a hopper 26 and an elevator 28.

Loose paving material 30 can be deposited onto a work surface 32 via a dump truck or other suitable means. The paving machine 10 can include means for moving the loose paving material 30 into the hopper 26, such as the elevator 28. The paving material 30 can be asphalt, aggregate materials or concrete. In various embodiments, the paving material 30 can be deposited directly into the hopper 26 of the paving machine 10. The paving machine 10 can travel in direction D, while the conveyor system 24 can move paving material in the opposite direction from the hopper 26 to the auger system 16.

The conveyor system 24 can be disposed within or below the hopper 26. The conveyor 26 can transport the loose paving material 30 through the vehicle portion 18 toward the auger system 16. A grading implement, such as the screed assembly 14, can be attached to the rear of the vehicle portion 18 to receive the paving material 30 from the auger system 16. The screed assembly 14 can be towed by tow arms 20A, only one of which is shown in FIG. 1. The propulsion system 22 can comprise a ground engaging element, such as an endless track as shown in FIG. 1, wheels or the like for propelling the paving machine 10 along the work surface 32. The loose paving material 30 can be deposited by the conveyor system 24 in front of the auger system 16. The auger system 16 can disperse the loose paving material 30 along the width (into the plane of FIG. 1) of the screed assembly 14. The screed assembly 14 can compact the loose paving material 30 into a mat 34 behind the paving machine 10.

More particularly, in order to facilitate formation of the mat 34, the paving machine 10 can be outfitted with the screed plate 13. The screed plate 13 can be configured to spread a smooth even layer of the paving material on the prepared roadbed as the mat 34. The weight and/or a vibration of the screed assembly 14 aids in compressing the paving material and performing initial compaction of the paving material layer into the mat 34. To facilitate laying of the paving material 30 as the mat 34, the screed plate 13 can be heated to a temperature in the range of about 82° to 171° C. (180° to 340° F.). Heating the screed plate 13 can assist the paving material 30 in flowing under the screed plate 13 and can reduce adhesion of the paving material 30 to the screed plate 13.

Figure 2:
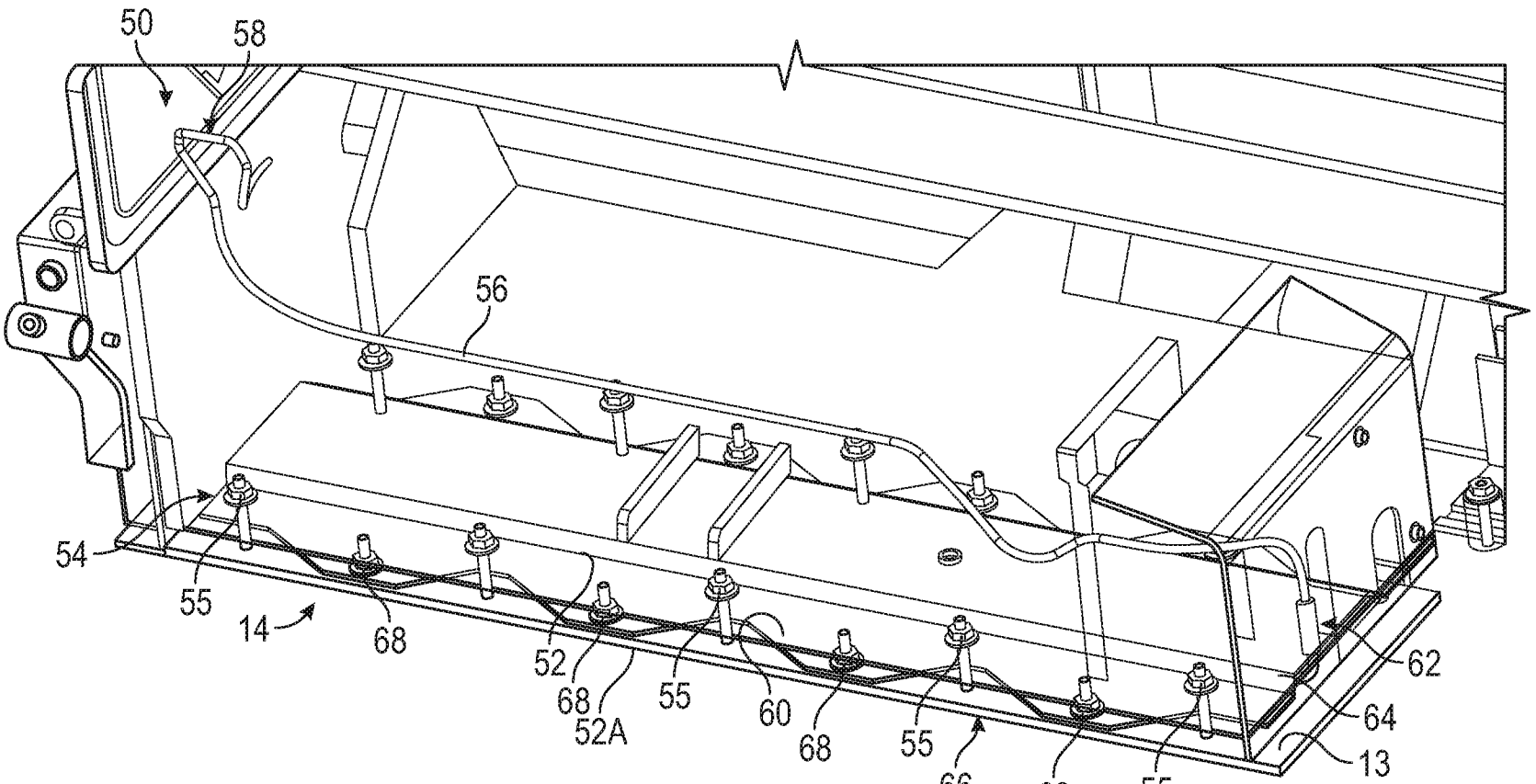
FIG. 2 is a rear perspective view of the screed assembly with portions shown in phantom so as to further illustrate a screed plate, a holder and a heater assembly according to an example of the present application.

FIG. 2 shows a portion 50 of a screed assembly 14 from the rear. The screed assembly 14 can typically be separated into several separate portions positioned at different positions relative to a cross-directional width of the paving machine 10. Only the single portion 50 is shown in FIG. 2 with the understanding that each portion (or section) will have a separate screed plate, frame assembly, heater assembly, holder etc. that can be constructed in the manner described herein. Separating the screed assembly 14 in this manner can allow for ease of access and removal of components for maintenance and other purposes. Thus, it is contemplated that the screed assembly 14 can be any of a number of configurations such as a fixed width screed or a multiple section screed that includes extensions.

FIG. 2 shows a trailing or rear side 52 of the screed assembly 14 including a trailing edge 52A of the screed plate 13. A frame 54 of the screed assembly 14 physically connects components such as the screed plate 13 back to the screed side plate 12A. In the case of the screed plate 13, such physical connection to the frame 54 can be via a number of fasteners 55 such as bolts and nuts, some of which are illustrated in FIG. 2. As previously discussed, the screed assembly 14 can be connected back to the paving machine 10 via one or more tow arms (not shown in FIG. 2 but illustrated in FIG. 1) or another means.

A cable 56 of a heater assembly 58 passes through the frame 54. The cable 56 can extend to physically and electrically connect with a physical and electrical connection of the paving machine 10. The heater assembly 58 passes through the frame 54 to a location where a heating element (not shown in FIG. 2) thereof can be positioned between a holder 60 and the screed plate 13 as will be illustrated and discussed subsequently. In this location, the heating element of the heater assembly 58 can heat the screed plate 13 to a temperature range as desired as discussed above. The holder 60 will be further discussed subsequently and can be configured to house and provide a clamping force on the heater assembly 58.

The frame 54 can have an access port 62 along a side 64 thereof. The access port 62 allows for withdrawal of the heater assembly 58 from the side 64 for repair or replacement of the heater assembly 58. The frame 54 can be spaced from the screed plate 13 and the holder 60 along the rear side 52. This arrangement can provide a second access port 66 to the holder 60 along the rear side 52. The second access port 66 can be configured to allow personnel to reach fasteners 68 (e.g., nuts and bolts) that physically connect the holder 60 to the screed plate 13. By loosening these fasteners 68, the clamping force of the holder 60 on the heater assembly 58 can be reduced or removed to facilitate withdrawal of the heater assembly 58 through the access port 62.

The screed plate 13 and holder 60 can be constructed of appreciate material such as high wear steel or other metal. The contour of the screed plate 13 can determine the quality, evenness and smoothness of the paving material that is being laid down. As such the screed plate 13 (and holder 60) can be flexed under tensile loads during use to achieve desired crowning or other surface contours. The heater assembly 58 can be configured to heat the screed plate 13 and can be connected to a power supply such as an electric generator. A greater number heater assemblies can be provided for each screed plate 13 then is shown, for example, in FIGS. 2-4. The length and number of such heater assemblies 58 can vary depending on various factors including the length the screed plate 13.

Figure 3:
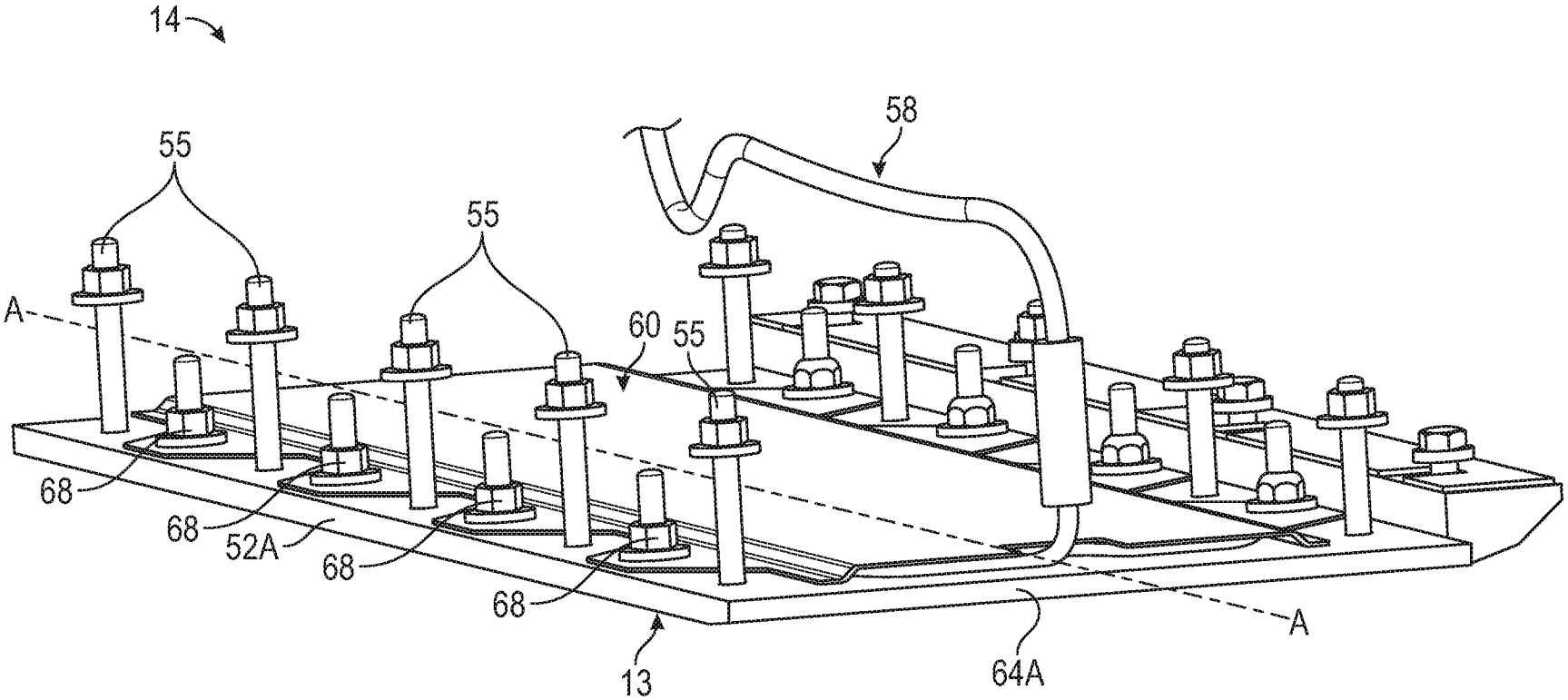
FIG. 3 is a side perspective view of the screed plate, the holder and the heater assembly according to an example of the present application.
Figure 3A:
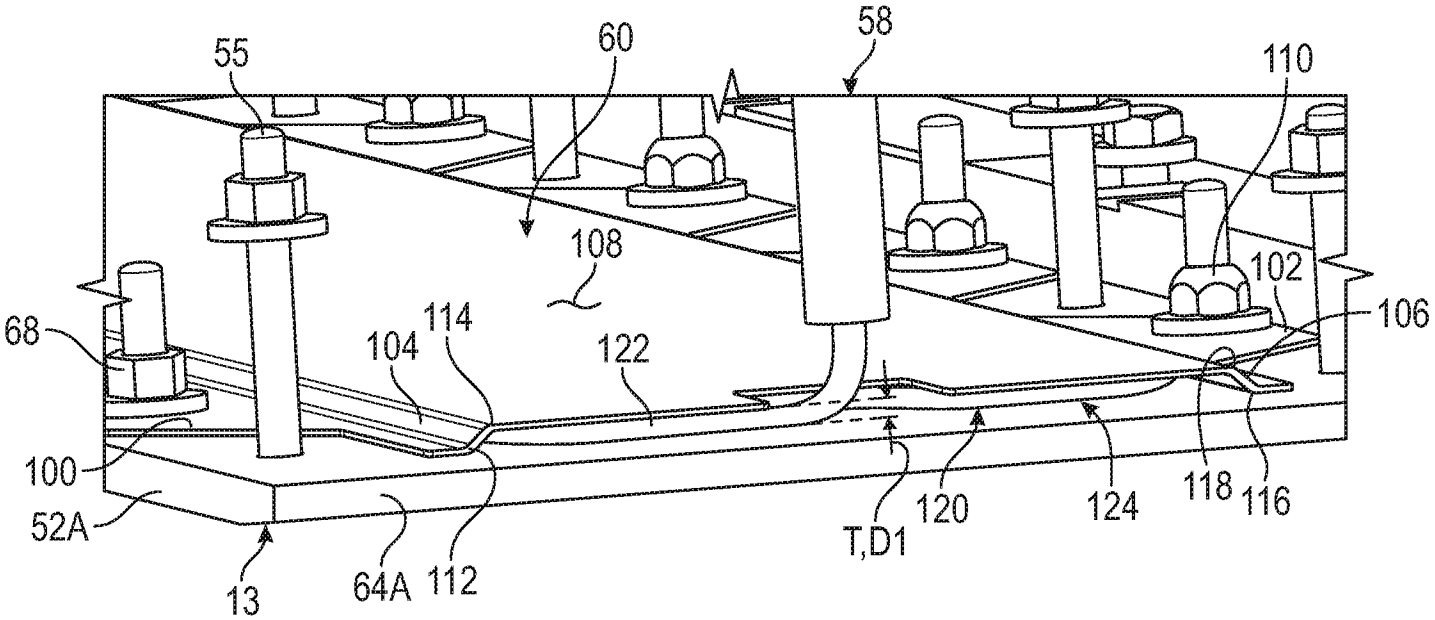
FIG. 3A is an enlargement of portions of the screed plate, the holder and the heater assembly of FIG. 3.

FIG. 3 shows the screed plate 13, the heater assembly 58, the fasteners 55 and 68 and the holder 60 with other portions of the screed assembly 14 such as the frame 54 (FIG. 2) removed. FIG. 3A is an enlargement of a portion of FIG. 3.

In FIGS. 3 and 3A the screed plate 13 is positioned below the holder 60 and the heater assembly 58 and has the trailing edge 52A and a second edge 64A. The second edge 64A generally corresponds to the side 64 (FIG. 2) of the frame 54 (FIG. 2).

The holder 60 can be physically connected to the screed plate 13 by the fasteners 68. The holder 60 can comprise a metal plate constructed of a metal such as steel having a thickness of several millimeters, for example. As best shown in FIG. 3A, the holder 60 can include a first plurality of flanges 100, a second plurality of flanges 102, a first transition section 104, a second transition section 106 and a raised middle section 108.

The holder 60 can be symmetrically constructed along an axis A (FIG. 3). This axis A (FIG. 3) can extend parallel with the trailing edge 52A. The first plurality of flanges 100 can be configured to interface with the screed plate 13 adjacent the trailing edge 52A. The first plurality of flanges 100 can be configured to receive bolt portions of the fasteners 68 to couple the holder 60 to the screed plate 13. The second plurality of flanges 102 can generally oppose the first plurality of flanges 100 across the axis A (FIG. 3). Similar to the first plurality of flanges 100, the second plurality of flanges 102 can be configured to interface with the screed plate 13 and can be configured to receive bolt portions of the fasteners 110 to couple the holder 60 to the screed plate 13.

The first transition section 104 can connect with the first plurality of flanges 100 at a trailing edge side 112 and can extend away from the screed plate 13 at an angle to a leading edge side 114. The first transition section 104 can connect to the raised middle section 108 at the leading edge side 114. Due to the shape of the first transition section 104, the trailing edge side 112 can be positioned relatively closer to (at) the screed plate 13 relative to the leading edge side 114.

The first transition section 104 can extend generally parallel with the trailing edge 52A and the axis A (FIG. 3) along the screed plate 13.

The second transition section 106 can mirror the construct of the first transition section 104 but in an opposing manner as it is positioned across the axis A (FIG. 3) thereform. Thus, the second transition section 106 can connect with the second plurality of flanges 102 at a second leading edge side 116 and can extend away from the screed plate 13 at an angle to a second trailing edge side 118. The second transition section 106 can connect to the raised middle section 108 at the second trailing edge side 118. Due to the shape of the second transition section 106, the second leading edge side 116 can be positioned relatively closer to (at) the screed plate 13 relative to the second trailing edge side 118. The second transition section 106 can extend generally parallel with the trailing edge 52A and the axis A (FIG. 3) along the screed plate 13.

The raised middle section 108 can be connected to the first transition section 104 and the second transition section 106 and can have a relatively flat extent therebetween. Together the raised middle section 108, the first transition section 104 and the second transition section 106 can form a channel 120 that is also bounded by the screed plate 13. This channel 120 can be configured to receive a heating element 122 of the heater assembly 58 therein. The channel 120 can have an opening 124 on a single side corresponding to the second edge 64A and the side 64 (FIG. 2). This opening 124 can be configured to receive the heater assembly 58, more particularly, the heating element 122. The channel 120 can be enclosed on all other sides (in the example of FIGS. 3 and 3A three sides) to limit access to the heating element 122.

When the holder 60 is connected down fully to the screed plate 13, the raised middle section 108 can be spaced from the screed plate 13 a distance D1 that is less than a thickness T of the heating element 122 of the heater assembly 58. Thus, an interference resulting in the clamping force is applied by the holder 60 to the heating element 122 as a result in the difference between the distance D1 and the thickness T. As discussed previously, if it is desired to remove the heating assembly 58 including the heating element 122 from between the holder 60 and the screed plate 13, the nuts of the fasteners 68 can be loosened (the nuts of the fasteners 110 can remain in a fully tightened position) to increase the distance D1 to reduce or remove the clamping force. This configuration facilitates removal of the heating element 122 from the channel 120 through the opening 124.

Thus, in brief summary and according to the embodiments of FIGS. 2-3A, the screed assembly can be configured with the holder receiving the heating element via the channel and thereby aligning the relative to the axis of symmetry of the screed plate. The channel can be enclosed on all sides save for the opening, and the opening can face a cross-path side of the screed plate. The channel and heating element can be separated from a trailing edge of the screed plate by the holder. The holder can have a symmetric shape including a raised middle section spaced from the screed plate when the holder is connected thereto. The holder can have a plurality of trailing edge flanges positioned on a first side of the middle section and a plurality of leading edge flanges positioned on a second side of the middle section. When the holder is removably connected to the screed plate, the raised middle section can be spaced from the screed plate a distance that is less than a thickness of the heating element, whereby an interference resulting in a clamping force is applied by the holder to the heating element as a result in the difference between the distance and the thickness. The holder can be removably connected to the screed plate at a trailing portion thereof and a leading portion thereof relative to the axis of symmetry. A plurality of fasteners can removably connect the holder at the trailing portion and these can be configured to be loosened to allow for the distance between the raised middle section and the screed plate to increase thereby reducing or eliminating the clamping force and allowing for removal or insertion of the heating element. A screed frame is disclosed in FIG. 2 that is configured to be spaced from the screed plate and holder along trailing sides thereof to provide an first opening for access to the plurality of fasteners. The screed frame can have a second opening along a second side substantially transverse to the trailing side. The second opening can interface with the heater assembly and the opening to the channel. The holder can be positioned on the screed plate and configured to position elongated portions of the heating element equidistance from the axis of symmetry.

Figure 4:
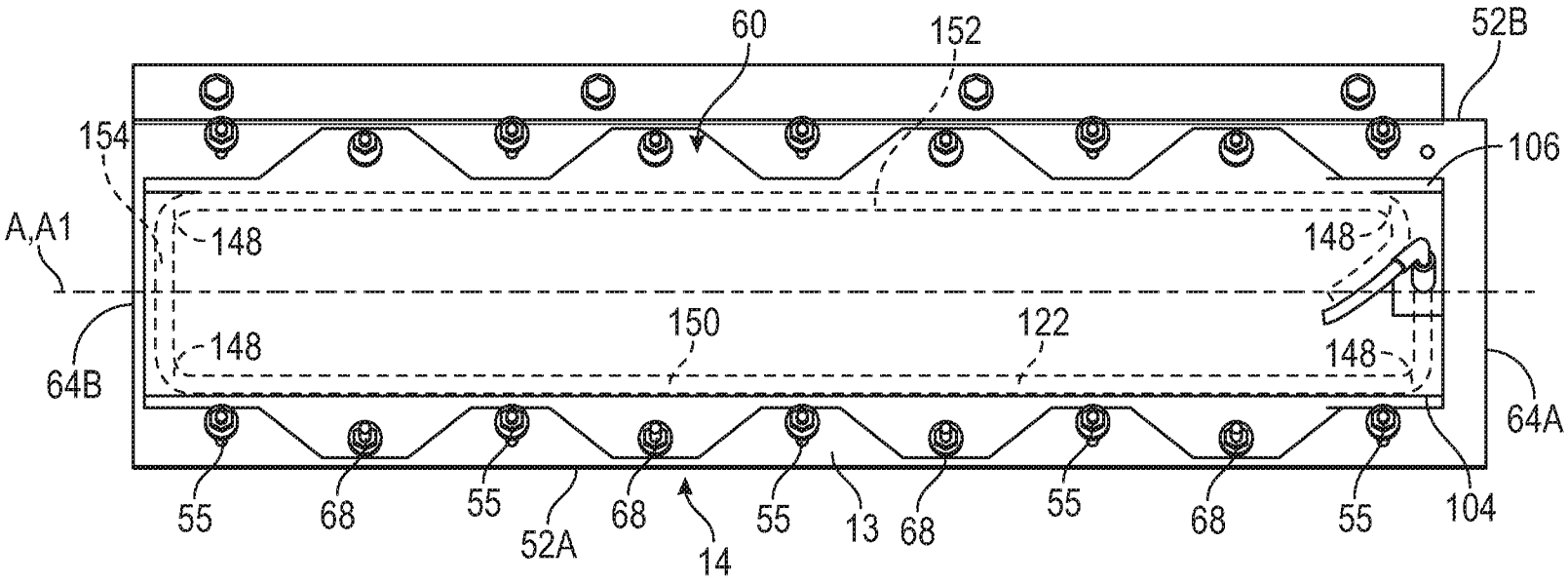
FIG. 4 is a top plan view of the screed plate, the holder of FIG. 3 with the heater assembly shown in phantom according to an example of the present application.

FIG. 4 shows a top down view of portions of the screed assembly 14 including the screed plate 13, the fasteners 55 and 68 and the holder 60 with other portions of the screed assembly 14 such as the frame 54 (FIG. 2) removed and the heating element 122 shown in phantom.

As shown in FIG. 4, the heating element 122 can have an extended rectangular or oblong shape from the top down view provided with four curved corners 148, a first extended portion 150, a second extended portion 152 and an end portion 154. The first extended portion 150 can connect with the second extended portion 152 via two of the curved corners 148 and the end portion 154. The end portion 154 can be positioned within the channel 120 adjacent an end thereof (an end of the holder 60) and can be positioned adjacent (within a few inches of) another edge 64B of the screed plate 13 that opposes the second edge 64A.

The heating element 122 can be configured as a thin, elongate sheet or ribbon and formed from a resistive conductor, such as a thin conductive wire or ribbon. However, alternate designs of heating element 122 can be utilized, such as those that present a broader thickness profile due to a circular cross-sectional shape. A resistive conductor within each heating element 122 terminates with a set of leads or electrical conductors that protrude from the holder 60.

In the example of FIG. 4, the holder 60, in particular with the channel 120, are configured to align the heating element 122 relative to the axis A of symmetry of the holder 60 and an axis of symmetry A1 of the screed plate 13. This axis of symmetry A1 can bisect the screed plate 13. Such configuration of the holder 60 with the channel 120 allows for alignment (with respect to axes A and A1) of the heating element 122 upon insertion into the channel 120. Further, this arrangement allows the first and second portions 150, 152 comprising elongated portions of the heating element 122 to extend generally parallel with and adjacent (in some cases abutting) the first transition section 104 and the second transition section 106, respectively. Thus, the first transition section 104 and the second transition section 106 can act as ramps or stops for positioning the first and second portions 150, 152 of the heating element 122 as desired. The arrangement of the heating element 122 (parallel with the axis A1 of symmetry can space the first extended portion 150 and the second extended portion 152 equidistant amounts from the trailing edge 52A and a leading edge 52B of the screed plate 13, respectively. Put another way, the extended portion 150 and the second extended portion 152 can be spaced equidistant from the axis of symmetry A1. This symmetric arrangement of the heating element 122 facilitated by the configuration of the holder 60 allows for a more uniform heat distribution along the screed plate 13 from the trailing edge 52A to the leading edge 52B.

INDUSTRIAL APPLICABILITY

Example machines in accordance with this disclosure can be used in a variety of industrial, construction, commercial or other applications including paving. Such machines can have one or more screed assemblies 12 including one or more screed plates 13 and corresponding holders 60 that are configured a clamping plates to apply a clamping force to a heater assembly 58 having heating element 122 sandwiched between the screed plate 13 and the holder 60. The screed assembly 12 can reduce the time and complexity associated with repair or replacement of the electric heater assembly 58, in particular, the heating element 122. In some embodiments, the heating element 122 can simply be slid out from between the holder 60 and the screed plate 13 by simply loosening easily accessible nuts at a rear (trailing side) of the screed assembly 12. Other nuts such as those that are relatively more inaccessible near a leading side of the screed assembly 12 and screed plate 13 do not need to be loosened to facilitate such removal of the heating element 122. The holder 60 and screed plate 13 can remain connected together during the removal of the heating element 122 and do not need to be entirely separated. Thus, the screed plate 13 does not need to be removed.

Furthermore, the present design of the screed assembly 12 in some embodiments facilitates ease of assembly of the heating element 122 with the holder 60 and the screed plate 13 in a manner the promotes more even heat transfer distribution. More particularly, after nuts on the trailing side of the screed assembly 12 are loosened a replacement or OEM heating element 122 can be inserted from a side. Such insertion can be into the channel 120 formed by the holder 60. The configuration of this channel 120 and holder 60 can align the heating element 122 symmetrically with respect to the axis A1 of symmetry of the screed plate 13. Such alignment promotes more even heat distribution.

Additionally, the holder 60 can be configured to enclose the heating element 122 on multiple sides including on the trailing edge side so as to prohibit or deter the entry of paving material adjacent the heating element 122. The design of the holder 60 with a large raised middle portion, single piece construction and symmetric shape promotes a more even clamping force application, which can avoid or reduce the likelihood of the development of hot spots on portion so the screed plate 13.

Typical screed assemblies such as those of such as those of U.S. Pat. No. 9,181,662 are not configured to provide for one or more of even clamping force application, ease of removal of the heating element, ease of installation of the heating element, ease of access for removal or installation, alignment of the heating element and/or enclosure of the heating element in the manner of the embodiment discussed above.

The above detailed description is intended to be illustrative, and not restrictive. The scope of the disclosure should, therefore, be determined with references to the appended claims, along with the full scope of equivalents to which such claims are entitled. The claims should be considered part of the specification for support purposes.

What is claimed is:

1. A screed assembly for use with a paving machine, comprising:

a screed plate having an axis of symmetry between a leading edge and an opposing a trailing edge;

a holder configured to be removably connected to the screed plate and configured to be positioned thereon, wherein when connected thereto the screed plate and the holder form a channel having an opening at one end thereof, wherein the holder is coupled to the screed plate by a plurality of fasteners positioned adjacent the trailing edge of the screed plate;

a heater assembly having a heating element configured to be received in the channel and to be aligned by the holder when so received relative to the axis of symmetry of the screed plate; and a screed frame configured to be spaced from the screed plate and holder along the trailing edge to provide a first opening for access to the plurality of fasteners that couple the holder to the screed plate.

2. The screed assembly of claim 1, wherein the channel is enclosed on all sides save for the opening, and wherein the opening faces a cross-path side of the screed plate.

3. The screed assembly of claim 1, wherein the channel and heating element are separated from a trailing edge of the screed plate by the holder such that the holder acts as a cover to protect the heating element from debris.

4. The screed assembly of claim 1, wherein the holder has a symmetric shape including a raised middle section spaced from the screed plate when the holder is connected thereto, a plurality of trailing edge flanges positioned on a first side of the middle section and a plurality of leading edge flanges positioned on a second side of the middle section.

5. The screed assembly of claim 4, wherein when the holder is removably connected to the screed plate, the raised middle section is spaced from the screed plate a distance that is less than a thickness of the heating element, whereby an interference resulting in a clamping force is applied by the holder to the heating element as a result in the difference between the distance and the thickness.

6. The screed assembly of claim 5, wherein the holder is removably connected to the screed plate at a trailing portion thereof and a leading portion thereof relative to the axis of symmetry, and wherein the plurality of fasteners removably connect the holder at the trailing portion are configured to be loosened to allow for the distance between the raised middle section and the screed plate to increase thereby reducing or eliminating the clamping force and allowing for removal of the heating element.

7. The screed assembly of claim 1, wherein the screed frame has a second opening along a second side substantially transverse to a trailing side of the frame, wherein the second opening interfaces with the heater assembly and the opening to the channel.

8. The screed assembly of claim 1, wherein the holder is positioned on the screed plate and configured to position elongated portions of the heating element equidistance from the axis of symmetry.

9. A paving system for laying an asphalt paving material, comprising:

a paving machine; and a screed assembly configured to be removably connected to the paving machine, the screed assembly comprising:

a screed plate having a leading edge and an opposing a trailing edge;

a holder configured to be removably connected to the screed plate and configured to be positioned thereon, wherein when connected thereto, the screed plate and the holder form a channel enclosed along a trailing side and having an opening at one end thereof;

a heater assembly having a heating element configured to be received in the channel; and a screed frame configured to be spaced from the screed plate and holder along trailing sides thereof to provide a first opening for access to a trailed edge facing side of the holder from along the trailing edge of the screed plate.

10. The paving system of claim 9, wherein the holder is configured to align the heating element when the heating element is received in the channel so that elongated portions thereof extend substantially parallel to an axis of symmetry of the screed plate.

11. The paving system of claim 9, wherein when the holder has a raised middle section that forms a part of the channel, and wherein when the holder is removably connected to the screed plate, the raised middle section is spaced from the screed plate a distance that is less than a thickness of the heating element, whereby an interference resulting in a clamping force is applied by the holder to the heating element as a result in the difference between the distance and the thickness.

12. The paving system of claim 11, wherein the holder is removably connected to the screed plate at a trailing portion thereof and a leading portion thereof relative to the axis of symmetry, and wherein a plurality of fasteners removably connect the holder at the trailing portion are configured to be loosened to allow for the distance between the raised middle section and the screed plate to increase thereby reducing or eliminating the clamping force and allowing for removal of the heating element.

13. The paving system of claim 9, wherein the screed frame has a second opening along a second side substantially transverse to a trailing side of the frame, wherein the second opening interfaces with the heater assembly and the opening to the channel.

14. A screed assembly for use with a paving machine, comprising:

a screed plate having a leading edge and an opposing a trailing edge;

a holder configured to be removably connected to the screed plate and configured to be positioned thereon, wherein when connected thereto the screed plate and the holder form a channel having a wall along a side facing the trailing edge of the screed plate and an opening at one end thereof, the channel and opening are positioned substantially transverse to the trailing edge of the screed plate; and a heater assembly having a heating element configured to be received in the channel, wherein the channel and heating element are separated from the trailing edge of the screed plate by the wall along the side facing the trailing edge of the screed plate such that the holder encloses and acts as a cover to protect the heating element from debris entering the channel from the side facing the trailing edge.

15. The screed assembly of claim 14, wherein the holder has a symmetric shape including a raised middle section spaced from the screed plate when the holder is connected thereto, a plurality of trailing edge flanges positioned on a first side of the middle section and a plurality of leading edge flanges positioned on a second side of the middle section.

16. The screed assembly of claim 15, wherein when the holder is removably connected to the screed plate, the raised middle section is spaced from the screed plate a distance that is less than a thickness of the heating element, whereby an interference resulting in a clamping force is applied by the holder to the heating element as a result in the difference between the distance and the thickness.

17. The screed assembly of claim 16, wherein the holder is removably connected to the screed plate at a trailing portion thereof and a leading portion thereof relative to the axis of symmetry, and wherein a plurality of fasteners removably connect the holder at the trailing portion are configured to be loosened to allow for the distance between the raised middle section and the screed plate to increase thereby reducing or eliminating the clamping force and allowing for removal of the heating element.

18. The screed assembly of claim 17, further comprising a screed frame configured to be spaced from the screed plate and holder along trailing sides thereof to provide a first opening for access to the plurality of fasteners.

19. The screed assembly of claim 14, wherein the holder is configured to align the heating element when the heating element is received in the channel so that elongated portions thereof extend substantially parallel to an axis of symmetry of the screed plate.

* * * * *